US005991953A

United States Patent [19]

Durenberger et al.

[11] Patent Number: 5,991,953

[45] Date of Patent: Nov. 30, 1999

[54] SWEEPING MACHINE WITH MULTIPLE POSITION FRONT FLAP

[75] Inventors: Donald F. Durenberger, Dayton; Michael T. Basham, Maple Grove; Joseph F. D'Costa, New Hope, all of Minn.

[73] Assignee: Tennant Company, Minneapolis, Minn.

[21] Appl. No.: 09/139,301

[22] Filed: Aug. 25, 1998

[51] Int. Cl.[6] ..... E01H 1/04

[52] U.S. Cl. ..... 15/83

[58] Field of Search ..... 15/83–86, 79.2

[56] References Cited

U.S. PATENT DOCUMENTS 2,275,356 3/1942 Funk ..... 15/83

*Primary Examiner*—Randall E. Chin

*Attorney, Agent, or Firm*—Dorn, McEachran, Jambor & Keating

[57] ABSTRACT

A sweeping machine includes a chassis with wheels supporting the chassis on a surface to be swept. There is a brush mounted on the chassis for rotation in a direction to throw debris over the brush and into a debris hopper mounted on the chassis behind the brush. A flap assembly is positioned in front of the brush and closely adjacent thereto. The flap assembly has a flexible lip which is in contact with a surface being swept during its normal position. There is an operator control and a connection between the operator control and the flap assembly for raising and lowering the flap assembly between the normal position in which the flexible lip is in contact with a surface being swept, a first raised position in which the flexible lip has been raised substantially vertically a small distance above the surface being swept, and a second raised position in which the flap assembly has been raised and pivoted in a forward direction relative to the first position to permit debris to pass under the flap assembly to an area about the rotatable brush.

10 Claims, 6 Drawing Sheets

18
20
48
46
50
32
82
38
70
68
74
40
36
37
64
72
44
52
78
76
65
62
42
58
34
63
60
61
54
30
10

84
22
80
82
24
86
90
88
112
100
96
94
92
110
98
102
101
104
97
106
30
10
26

SWEEPING MACHINE WITH MULTIPLE POSITION FRONT FLAP

THE FIELD OF THE INVENTION

The present invention relates to sweeping machines and more specifically to what is known in the art as over-the-top sweepers. In such machines, the main sweeping brush throws debris up and over the top into a debris hopper which is located behind the brush. This is in contrast with a forward throw sweeping machine in which debris is directed toward a hopper which is in front of the brush.

It is inherent in over-the-top sweeping machines that the front wall of the brush housing and the sweeping lip must conform quite closely to the main brush to enable the brush to efficiently lift debris up and over it into the hopper. This causes problems with the sweeping lip not encountered with forward throw sweepers. The lip must be flexible to admit debris under it and it must drag on the floor to prevent the brush from throwing debris forward. Because the sweeping lip must be close to the brush, it cannot be lifted very high by debris, or large debris passing under it and lifting it up would lift the lip into the brush, which would then whip it up and hold it off the floor. This would block the passageway for debris up and over the brush and create an opening at floor level through which all debris would be thrown forward. As a result, the flexible lip in such machines is relative short and debris passing under it cannot lift it very high. This limits the size of debris that can be admitted to the brush. For example, sand will go under the flexible lip, but beverage cans will not. And in a very small machine, even a golf ball size object will not pass under the sweeping lip. Normally, such items simply accumulate in front of the lip and are pushed along by the sweeping machine.

The principal prior art solution has been a so-called "trap and flap" sweeping lip. The machine moving forward "traps" debris in front of the lip until the operator pushes a foot pedal that swings the flap in an upward and forward direction. This opens enough space for the larger debris to enter the chamber adjacent the brush. The driver will then release the pedal, the lip returns to normal position, and the debris is swept up and over the brush into the hopper.

Although this has been a common solution for a number of years to the described problem, there are disadvantages to such an arrangement. First, as the lip is raised to an open position, tends to throw the accumulated debris forward, and possibly some of it out the sides and away from the machine. The driver must hold the lip open while the machine pursues the scattered debris, and during that time smaller debris will be thrown forward. Second, when the driver releases the pedal and the lip moves back to its original position, the flexible part of the lip strikes the floor bent forward rather than backward as it should be. On a rough floor, the forward motion will usually buckle the lip and pull it back to where it should be, but on a smooth floor it may slide along pointing forward indefinitely and prevent any debris from entering the brush chamber.

The present invention solves the problem with the above-described prior art "trap and flap" sweeping lip. There is a foot pedal which the operator uses to lift the flap assembly when the sweeping lip encounters debris which is too large to pass under the lip in its normal position. However, the lifting action is different from prior art sweepers in that when the operator pushes the foot pedal, the sweeping lip first moves essentially straight up for a short distance, for example, approximately an inch. Further depression of the foot pedal swings the flap assembly forward and up to provide a larger opening. This action is reversed when the operator releases the pedal. First the lip swings down and back to an approximate vertical position where the lip is an inch or so off the floor. Further release of the foot pedal lowers the lip back down to its original operating position.

The action of the foot pedal and the movement of the flap assembly is such that the driver can feel the two distinct lip motions in the pedal. Many times it will only be necessary for the driver to lift the lip to the first raised position to admit debris, for example, a golf ball. This short lifting time will result in little or no debris being thrown forward. It is only necessary to move the flap assembly to the full or second raised position when larger debris is encountered and normally such will not be thrown forward by the lip, so this debris will move into the brush chamber for transfer into the rearwardly positioned debris hopper.

When the flap assembly is lowered back to its normal position, the flexible lip is vertical when it strikes the floor and the forward motion of the machine naturally bends it back, as there is nothing to cause it bend forward. Thus, the flexible sweeping lip is always returned to its normal position.

SUMMARY OF THE INVENTION

The present invention relates to sweeping machines and in particular to the front flap assembly for an over-the-top sweeping machine.

A primary purpose of the invention is to provide a flap assembly for the described environment in which the operator may move the flap assembly to a first partially raised position and a second fully raised position to accommodate debris which will not normally pass under the flexible sweeping lip.

Another purpose of the invention is to provide a reliable, simply constructed movable front flap assembly for a sweeping machine of the type described.

Another purpose is a front flap assembly for the described environment which includes a front bracket with a rear bracket pivoted thereto, with the rear bracket mounting the flexible sweeping lip, and the front bracket being pivoted to the chassis of the sweeping machine and a foot pedal connected to the rear bracket.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention relates to sweeping machines and more specifically to what is known in the art as an over-the-top sweeper in that the debris is moved over the top of the brush as it transfers to the debris hopper which is located behind the brush.

Figure 1:
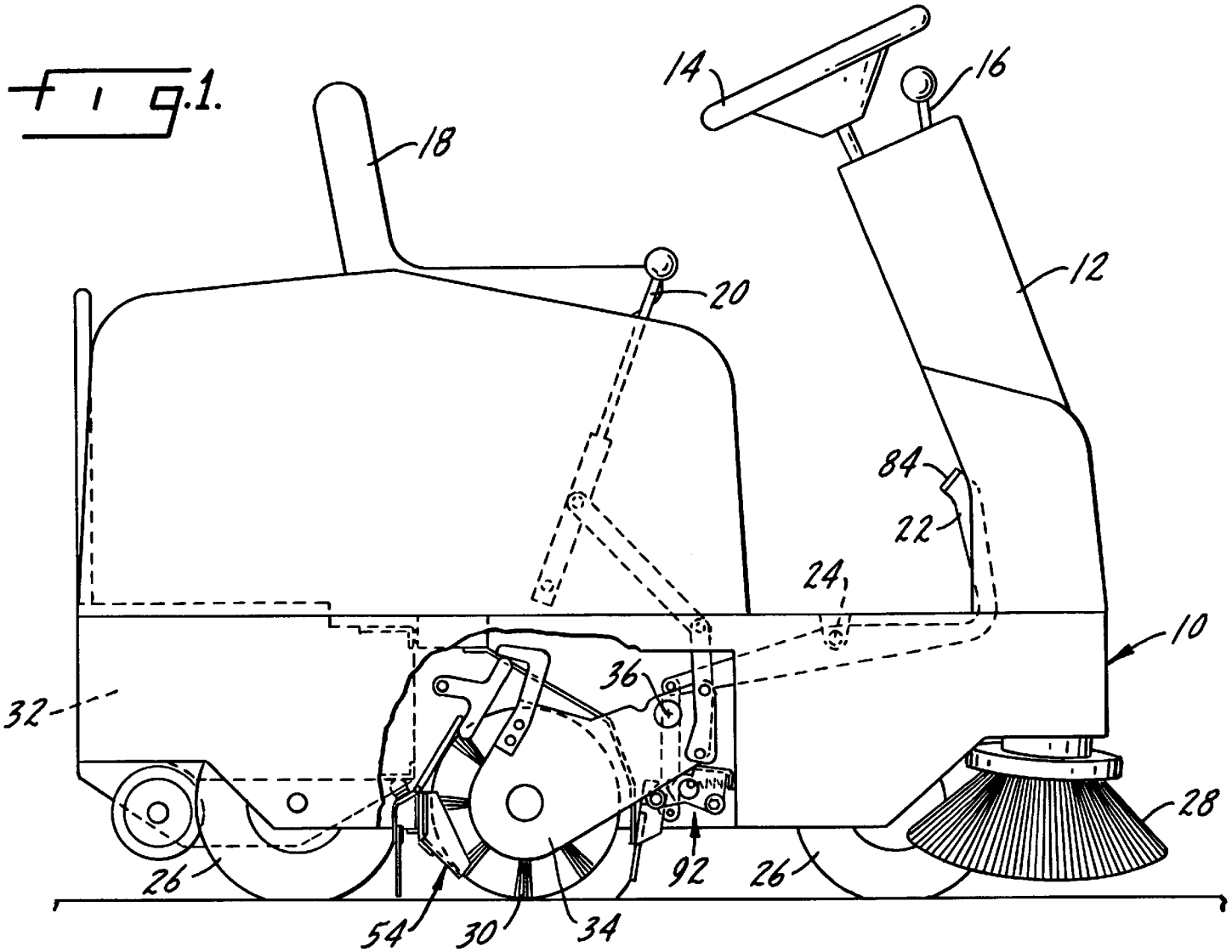
FIG. 1 is a side view, with portions broken away, of an over-the-top sweeping machine.

In FIG. 1, the sweeper includes a chassis 10 having a front control module 12 mounting a steering wheel 14 and a control lever 16. There is an operator seat 18 and a control lever 20 for use in changing the position of the sweeping brush relative to the surface being cleaned. A foot pedal 22 is pivotally mounted, as at 24, to the chassis 10, as will be described in more detail hereinafter. The chassis 10 is mounted on wheels 26 and may include front side brushes 28 and a main sweeping brush 30. Directly behind the brush 30 is a debris hopper 32. The brush 30 will have a conventional drive mechanism, not shown herein, but common on machines of this type.

Figure 2:
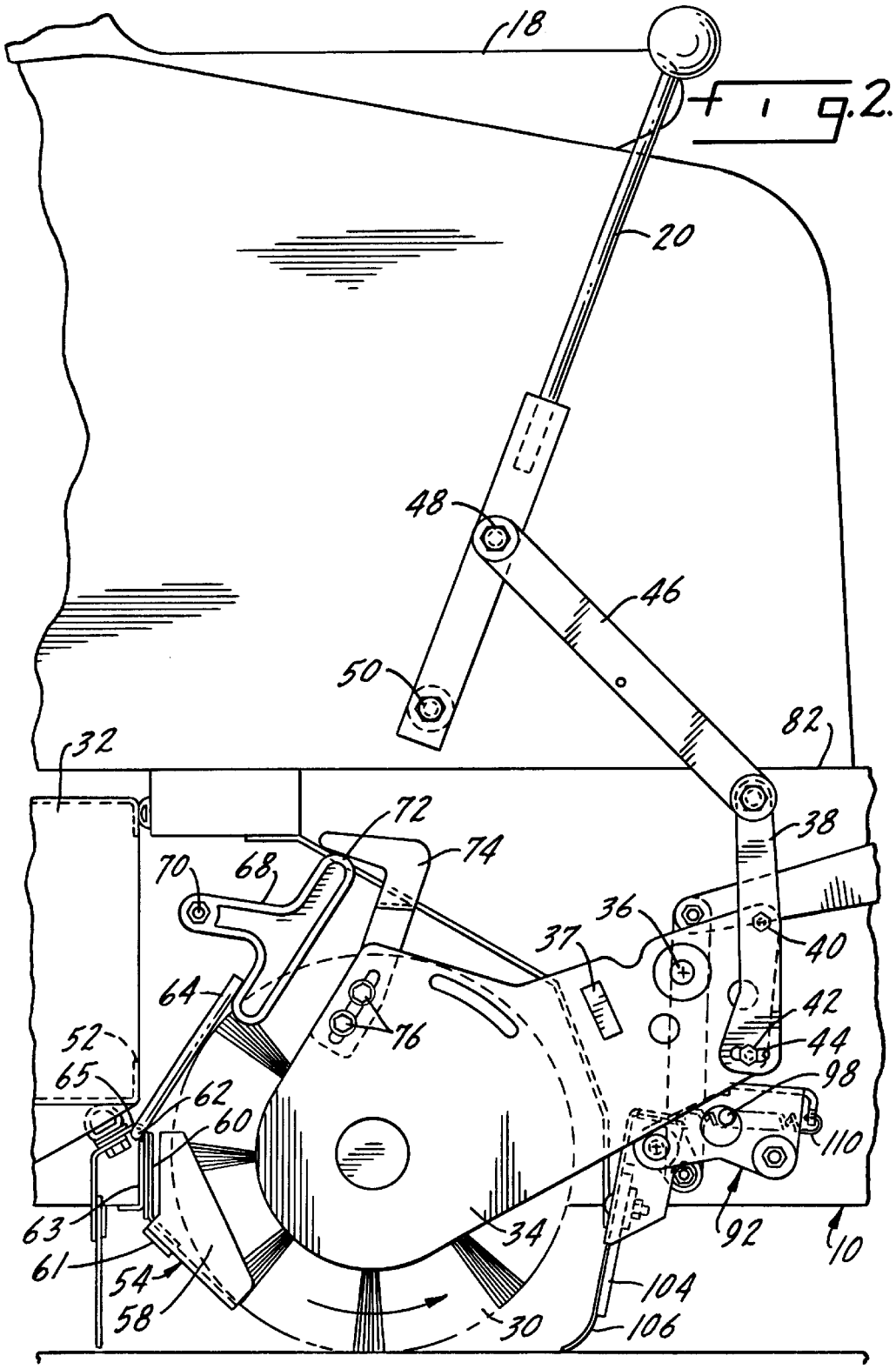
FIG. 2 is an enlarged partial side view illustrating the main sweeping brush and the mechanisms for moving the front flap and recirculation flap.

The main sweeping brush 30 is mounted for rotation between a pair of arms, one of which is indicated at 34. Each of the arms 34 will pivot about a pivotal mounting 36. The two arms are joined together in a torsionally rigid manner by a cross bar indicated at 37, and suitable fasteners, not shown. One arm 34 is attached to a link 38 by means of a fastener 40, midway of the link 38, and a fastener 42 at the lower end of the link 38, with the fastener 42 being located in an elongated slot 44. The upper end of link 38 is pivotally attached to an arm 46, which in turn is pivotally attached to the control lever 20. The lever 20 pivotally mounts the arm 46 intermediate its opposite ends, as at 48, and the lever 20 is pivotally attached to the chassis 10, as at 50. Thus, as shown in FIG. 2, pivotal movement of the lever 20 counterclockwise about its pivot point 50 has the effect of rotating the brush arms 34 about pivot point 36 in a counterclockwise direction. This movement is necessary to lower the brush as it becomes worn. Conventionally, sweeping brushes may wear from an 11" new diameter to an 8" worn diameter before the brush is discarded. In order to maintain the brush at the proper orientation relative to the surface to be cleaned, it is periodically lowered by the operator through manipulation of the lever 20. The above-described mechanism controls movement of the brush so that it is maintained in the proper location for sweeping.

Over-the-top sweepers throw all of the debris moved by the brush over the top of the brush and a percentage of such debris will drop between the brush and the front wall of the hopper. This dictates that a recirculation lip or flap be located directly behind the brush and that there be minimal clearance between the brush and the recirculation flap. Such clearance is preferably on the order of ¼" and must be maintained even when the brush is worn to a smaller diameter. The entrance into the debris hopper 32 is indicated at 52 and it is directly behind the brush 30. The recirculation flap is indicated generally at 54 and is located below and to the rear of the brush 30.

The flap 54 is made of a rubber or rubber-like material and has two side walls, one of which is indicated at 58. Flap 54 is attached to a support plate 60 by bolts and a retainer strip 61. Plate 60 is bolted to a second support plate 63, which has a round rod 62 welded along its upper edge. A "living hinge" 65, made of flexible rubber or rubber-like material, extends along support plate 63 and contributes to sealing the area against dust leakage. Rod 62 is journaled in portions of chassis 10, and the recirculation flap assembly as described here can pivot about it. Rod 62 includes a bent end 64 which extends upwardly and forwardly and is in contact with a T-shaped lever 68. The lever 68 is pivoted, as at 70, to a portion of the chassis 10 and has an upper end 72 in contact with an arm 74 which is bolted, as at 76, to the brush support arm 34.

Figure 3:
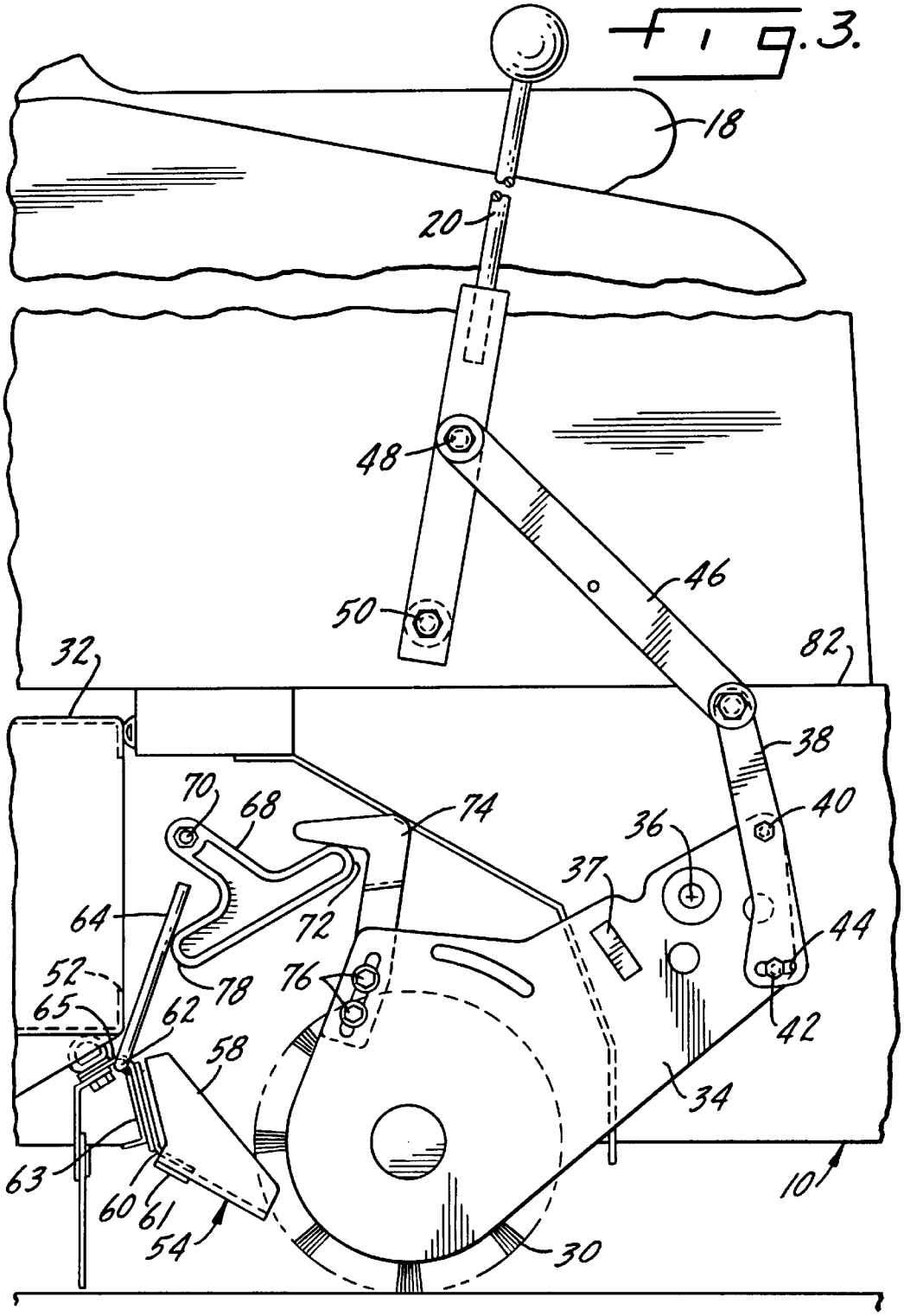
FIG. 3 is an enlarged partial side view, similar to FIG. 2, showing the recirculation flap in a second position.

FIG. 2 illustrates the relationship of the recirculation flap 54 and the brush 30 in a position in which the brush is new and it is at its full unused diameter. As the brush is worn, it will be periodically rotated about pivot point 36 so that it maintains a proper relationship to the surface being swept. FIG. 3 illustrates the brush in such a moved position. As the brush is pivoted about point 36 by movement of control lever 20, the arm 74, which is attached to the brush support arm 34, will also rotate in a counterclockwise direction. Movement of arm 74 will cause lever 68 to rotate in a clockwise direction, with the difference in position of this lever being shown by a comparison of FIGS. 2 and 3. As lever 68 moves in a clockwise direction, a lower portion thereof, indicated at 78, will cause counterclockwise movement of the arm 64 of rod 62. This in turn will pivot the recirculation flap in a counterclockwise direction so that it will maintain its proper orientation relative to the outer circumference of the brush 30. The difference in flap positions between FIGS. 2 and 3, and the difference in brush positions in the same two figures, illustrates the, related movement of the brush and the recirculation flap brought about by the combination of arm 74 attached to the brush support arm 34, the pivotal lever 68, and the rod 64 which is attached to the recirculation flap 54.

It is inherent in over-the-top sweepers that the front wall of the brush housing and the sweeping lip must conform quite closely to the brush to enable the brush to efficiently raise debris. The sweeping lip must be flexible to admit debris under it, and it must drag on the floor to prevent the brush from throwing debris forward. However, because it must remain close to the brush, the lip cannot be lifted very high, or large debris passing under it and lifting it up would lift the lip into the brush, which would then whip it up and hold it off the floor. This would block the passageway for debris up and over the brush and create an opening at floor level through which all debris would be thrown forward.

The present invention provides an operator usable foot pedal which lifts the front flap or sweeping lip to two distinct raised positions, a first position in which the front flap is raised approximately 1" above the surface being swept, with further depression of the pedal swinging the flap assembly forward and up to provide a larger opening.

The foot pedal 22 includes a bushing 24 by which it is pivotally mounted between brackets 80 on the underside of floor 82 of the chassis 10. One end of the foot pedal 22 has a foot portion 84 which is accessible to the operator, as is clearly shown in FIG. 1. The opposite or rear end of pedal 22 is pivotally mounted to a link 86. The lower end of link 86 is pivotally mounted to an arm 88 of a front flap bracket 90 which forms a part of a flap assembly indicated generally at 92 and shown in exploded perspective form in FIG. 4.

The front flap assembly 92 includes a front skirt bracket 94 having arms 96 at the ends thereof. The arms 96 are each pivotally attached, as at 97, to downwardly extending brackets 99 which extend from the underneath side of the floor 82 of the chassis 10. Each of the brackets 99 carries a pin 98 which will ride within a hole 100 in the arms 96, with the pins providing a stop to limit movement of the flap assembly 92.

Figure 4:
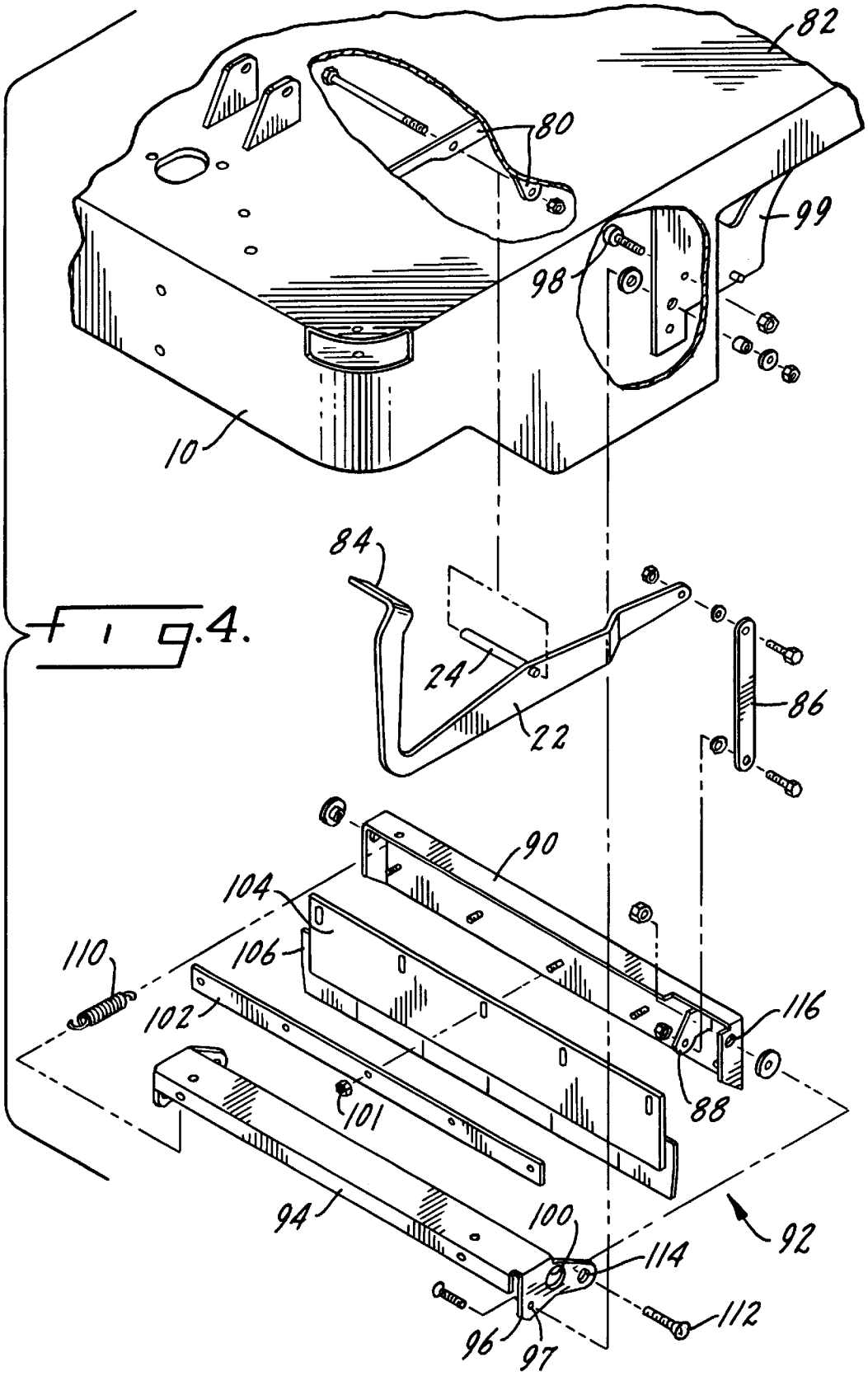
FIG. 4 is an exploded perspective illustrating the foot pedal and its connection to the front flap.

The assembly 92 includes a retainer 102 and a skirt 104 which has a downwardly extending flexible flap 106 which functions as the so-called lip of the front flap. The skirt 104 in turn will be attached to the front flap bracket 90 with fasteners 101. A spring 110 is connected at its opposite ends to the front flap bracket 90 and the front skirt bracket 94, as depicted in FIG. 4. The front flap bracket 90 is pivotally mounted to the front skirt bracket 94 by means of pins 112 which pass through an opening 114 in the skirt bracket 94 and an opening 116 in the front flap bracket 90.

Figure 5:
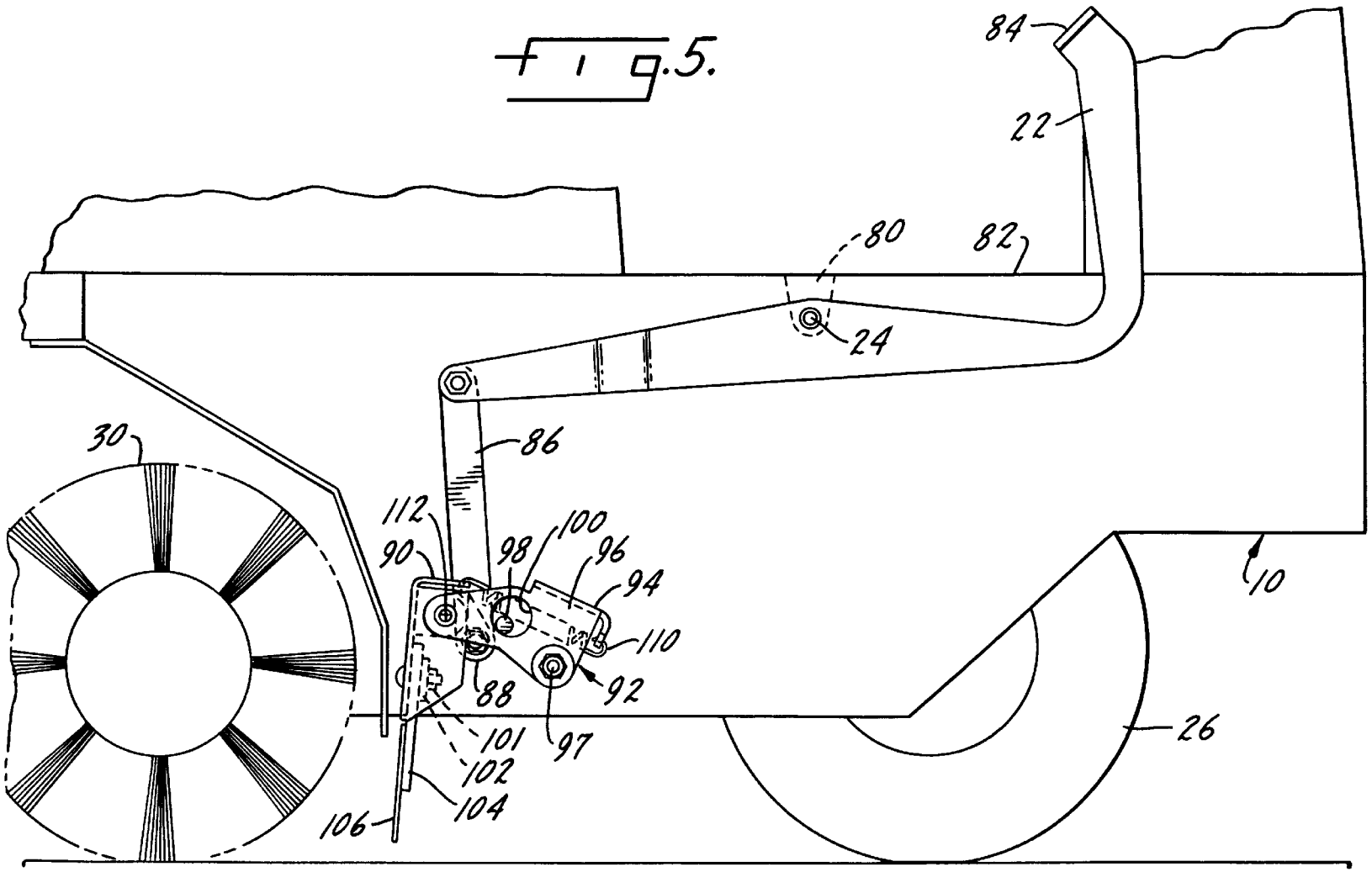
FIG. 5 is an enlarged side view illustrating the foot pedal and the front flap in a partially raised position.
Figure 6:
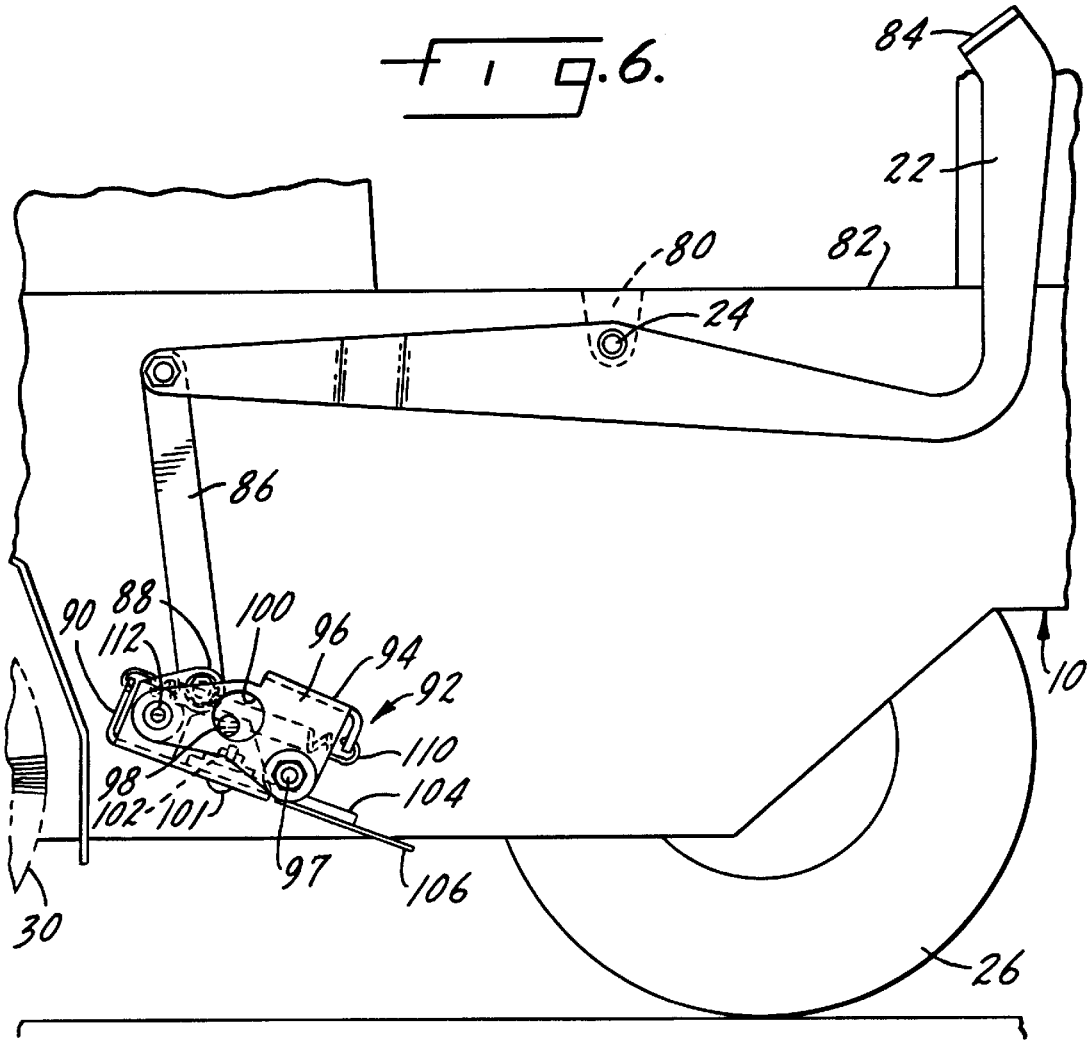
FIG. 6 is a side view, similar to FIG. 5, illustrating the foot pedal and front flap in a full raised position.

The various positions of the front flap assembly and the foot pedal are illustrated in FIGS. 2, 5 and 6. FIG. 2 illustrates the conventional and normal position of the front flap. It is located in front of the brush, with the flexible flap portion 106 being bent in a rearward direction so as in no way to impede debris from passing beneath the flap and into the zone of the brush 30. Small objects such as sand, pebbles and the like will easily pass under the flap and then be moved by the brush into the debris hopper. Larger items such as beverage cans will not pass under the front flap and may accumulate in front of it. It is to insure that this type of debris will be thrown into the debris hopper that the front flap assembly is movable.

The first movement by the operator is illustrated in FIG. 5. The pedal 84 has been depressed at its front end with the rear end rising. As the rear end rises, link 86 moves upwardly, which will pull the front flap bracket 90 and its attached skirt 104 in an upward direction, with a slight amount of counterclockwise rotation, as shown in FIG. 5. This movement will normally raise the front flap approximately 1", although that is merely illustrative. Note the different positions of the stop 98 within the opening 100 in FIG. 2 and in FIG. 5. The front flap bracket 90 and skirt 104 will pivot relative to the front skirt bracket 94, as these two portions of the flap assembly are relatively movable.

Further depression of the foot pedal 22, as illustrated in FIG. 6, will raise the link 86 to an even higher position which will rotate the front flap bracket and the attached skirt in a counterclockwise direction which both rotates the flap 106 and raises it. This will permit larger debris such as golf balls, beverage cans, etc., to pass beneath the flap and into the area adjacent the brush for movement by the brush into the debris hopper.

The above-described movement of the front flap is reversed when the operator releases the pedal. First, the front flap will return to the FIG. 5 position where it is approximately vertical and is approximately 1" off the floor. A further and final release of the foot pedal will lower it down to the FIG. 2 position and when the flap is so lowered to its normal position, the flexible portion is vertical when it strikes the floor and the forward motion of the machine naturally bends it back, as there is nothing to cause it to bend forward. Thus, the flap will be in its preferred and normal position and will again permit small debris to pass under it, but in no way will it hinder the movement of the brush in normal operation.

Whereas the preferred form of the invention has been shown and described herein, it should be realized that there may be many modifications, substitutions and alterations thereto.

The embodiments of the invention in which an exclusive property or privilege is claimed are defined as follows:

1. A sweeping machine including a chassis, wheels for supporting the chassis, a brush mounted on the chassis for rotation in a direction to throw debris over the brush and into a debris hopper mounted on the chassis behind the brush, a flap assembly positioned in front of the brush and closely adjacent thereto, said flap assembly having a flexible lip which is in contact with a surface being swept, an operator control and a connection between said operator control and said flap assembly for raising and lowering said flap assembly between a normal position in which said flexible lip is in contact with the surface being swept, a first raised position in which the flexible lip has been raised substantially vertically a small distance above the surface being swept, and a second raised position in which said flap assembly has been both raised and pivoted in a forward direction relative to said first raised position to permit debris to pass under said flap assembly to an area about said rotatable brush.

2. The sweeping machine of claim 1 wherein said operator control includes a foot pedal.

3. The sweeping machine of claim 1 wherein said flap assembly includes a front bracket and a rear bracket pivotally connected thereto, said flexible lip being attached to said rear bracket.

4. The sweeping machine of claim 3 including a link pivotally attached to said operator control and pivotally attached to said rear bracket.

5. The sweeping machine of claim 4 wherein said front bracket is pivotally attached to a portion of said sweeping machine chassis.

6. The sweeping machine of claim 5 including a spring connected between said front bracket and said rear bracket and normally urging said front and rear brackets toward a position in which said flexible lip is substantially vertical.

7. The sweeping machine of claim 5 wherein said control member is a foot pedal, pivotally mounted on said chassis, with one end of said foot pedal being pivotally connected to said link.

8. The sweeping machine of claim 7 wherein said foot pedal is pivotally mounted, generally intermediate its opposite ends, to said chassis, with one end of said foot pedal being pivotally connected to said link, and the other end of said foot pedal having a foot receiving portion.

9. The sweeping machine of claim 5 including stop means on said front bracket and said chassis limiting vertical movement of said flap assembly relative to said chassis.

10. The sweeping machine of claim 9 wherein said stop means includes a pin mounted on said chassis and an opening on said front bracket, with said opening moving relative to said pin as said front bracket pivots relative to said chassis.

* * * * *